US007094128B2

(12) United States Patent
Vianello et al.

(10) Patent No.: US 7,094,128 B2
(45) Date of Patent: Aug. 22, 2006

(54) AUTOMATIC MACHINE FOR GRINDING THE BORDERS OF GLASS PANES

(75) Inventors: Fortunato Vianello, Vallio Di Roncade (IT); Dino Moschini, Roncade (IT)

(73) Assignee: For.El Base di Vianello Fortunato & C. S.N.C, Vallio di Roncade (IT)

( * ) Notice: Subject to any disclaimer, the term of this patent is extended or adjusted under 35 U.S.C. 154(b) by 226 days.

(21) Appl. No.: 10/868,207

(22) Filed: Jun. 16, 2004

(65) Prior Publication Data

US 2004/0259475 A1 Dec. 23, 2004

(30) Foreign Application Priority Data

Jun. 20, 2003 (IT) ..... TV2003A0091

(51) Int. Cl.
*B24B 49/00* (2006.01)

(52) U.S. Cl. ..... 451/5; 451/8

(58) Field of Classification Search ..... 451/5–10, 451/28, 41, 42, 44
See application file for complete search history.

(56) References Cited

U.S. PATENT DOCUMENTS 3,943,667 A * 3/1976 Hoenigmann ..... 451/261
4,406,091 A * 9/1983 Eckardt et al. ..... 451/239
4,989,373 A 2/1991 Park
5,327,686 A 7/1994 Park
5,433,652 A 7/1995 Park
6,220,928 B1 * 4/2001 Okabe et al. ..... 451/5
6,431,964 B1 * 8/2002 Ishikawa et al. ..... 451/65
6,572,444 B1 * 6/2003 Ball et al. ..... 451/10
2004/0259475 A1 * 12/2004 Vianello et al. ..... 451/5

FOREIGN PATENT DOCUMENTS

EP 0 185 560 A 6/1986

* cited by examiner

*Primary Examiner*—Lee D. Wilson
(74) *Attorney, Agent, or Firm*—Modiano & Associati; Albert Josif; Daniel O'Byrne

(57) ABSTRACT

An automatic machine for grinding the borders of glass panes, particularly the edges, arranged preferably vertically but applicable to any other arrangement, comprising devices which allow the machining of glass panes, which are notoriously fragile and have an irregularly cut or even contoured perimeter by means of a rigid tool, such as a diamond grinding wheel, by acting simultaneously on the two edges along the perimeter of the pane. In particular, the machine comprises a feeler element and feedback circuits for symmetrically edging the glasspane and, advantageously, for keeping unchanged the perimetric profile of the pane.

17 Claims, 15 Drawing Sheets

AUTOMATIC MACHINE FOR GRINDING THE BORDERS OF GLASS PANES

The present invention relates to an automatic machine for grinding the borders of glass panes.

BACKGROUND OF THE INVENTION

Methods for grinding ("edging", in the jargon) the borders of glass panes as they result after they have been cut into the final formats for use are currently known. In principle, the grinding operation can be applied to any step of the working of the glass pane, for example before toughening.

Edging is performed for two reasons: the first reason relates to safety in handling said panes, the edges of which would be dangerously sharp if they were not ground. The second reason relates to eliminating the border defects of panes, typically so-called microcracks, which may trigger breakage of the pane in subsequent working steps (particularly during toughening) as well as in subsequent use.

In order to better understand the configuration of the glass pane, not so much in its possible separate use but especially in its use in combination with other components in order to constitute a so-called double-glazing unit, some concepts related to the intermediate component, i.e. the glass pane, and the final product, i.e. the double-glazing unit, are summarized hereafter. The subsequent use of the double-glazing unit, i.e. as a component of doors and windows, is known to the person skilled in the art and is not discussed here in detail.

With reference to FIG. 1, the double-glazing unit is typically constituted by two or more glass panes 1001, 1002, which are mutually separated by one or more spacer frames 1003, which are internally hollow and are provided with microperforations on the side directed toward the inside of the unit.

The spacer frames 1003 usually contain, in their hollow part, hygroscopic material, which is not shown in the figure. The chamber (or chambers) 1006 delimited by the glass panes 1001 and 1002 and by the frame 1003 may contain air or gas or mixtures of gases injected therein, which give the double-glazing unit particular properties, for example thermal insulation and/or soundproofing properties. The glass panes and the frame are mutually joined by means of two levels of seal: the first seal 1004 is adapted to provide a hermetic closure and affects the lateral surfaces of the frame 1003 and the portion adjacent thereto of the glass panes 1001, 1002; the second seal 1005 affects the compartment constituted by the outer surface of the frame and by the faces of the glass panes up to their borders and is adapted to provide cohesion between the components and to maintain the mechanical strength of the coupling between them.

FIG. 1 illustrates five possible sectional views of configurations of the double-glazing unit 1A, 1B, 1C, 1D, 1E, only the first of which has been described. However, it is straightforward to extend the considerations made above to the configurations 1B–1E, in which a plurality of frames or of panes are provided, said panes being optionally laminated. In the figure, the sun schematically represents the outside environment of a building in which the double-glazing units are installed, and the inside of the building is represented schematically by a radiator.

The glass panes used in the composition of the double-glazing unit may have different configurations depending on their use: for example, the outer pane 1001 (with respect to the building) may be normal or reflective in order to limit the input of heat during summer months, or can be laminated/armored (1D) for intrusion/vandalism prevention functions, or can be laminated/toughened (for security functions) or combined, for example reflective and laminated.

The internal pane 1002 (with respect to the building) may be normal or of the low-emissivity type, in order to limit heat loss during winter months, or laminated/toughened (for security functions) or combined (1E), for example of the low-emissivity type and laminated.

The brief summary provided above already makes it evident that a production line, in order to obtain the double-glazing unit, requires many operations in sequence and that both the intermediate components (i.e. the glass panes) and the finished product (i.e. the double-glazing unit) have the edges of the glass panes that are accessible for contact with the hands of the operators and users. It is therefore important to increase safety by beveling the peripheral borders of the glass panes. If the finished product, which in any case has a considerable added value with respect to the individual pane, had sharp pane borders or sharp-edged panes, it would be degraded in terms of quality and commercial value.

The processes for producing the double-glazing unit are typically numerous, and each one requires a corresponding particular machine to be arranged in series with respect to the other complementary ones. Some processes or operations, cited by way of non-limiting example and at the same time not all necessary, are the following:

REMOVAL, on the peripheral face of the pane, of any coatings in order to allow and maintain over time the bonding of the sealants;

WASHING of the individual panes, alternating an inner pane with an outer pane (the orientation being the one defined above);

APPLICATION OF THE SPACER FRAME: the previously manufactured frame, filled with hygroscopic material and coated on its lateral faces with an adhesive sealant, which has a sealing function, is applied to one of the panes that constitute the double-glazing unit in a specifically provided station of the double-glazing unit production line;

COUPLING AND PRESSING of the assembly constituted by the panes and the frame or frames;

FILLING WITH GAS of the chamber or chambers thus obtained;

SECOND SEALING.

The processes listed above may be performed by the respective machine automatically or semiautomatically, but in any case entail contact of the intermediate components and of the finished products with the operator, for example during loading and unloading of the line and in subsequent steps for storage, transport, assembly and installation of the double-glazing units.

In known manual processes, the glass panes, rested on supporting surfaces, are placed in contact with belt grinders, which are arranged sequentially and are angularly staggered so as to bevel both edges of the side of the pane (methods of this type are disclosed for example in DE-A 44 19 963). The main drawbacks that arise from the known methods described above relate to the considerable bulk and cost of the machines, to the complex operations for process maintenance (such as replacement of the abrasive belts), the less than optimum quality of the grinding operation, the abnormal behavior of the belt in interaction with the pane when its width does not overlap the pane completely (i.e. at the end of the side of the pane), and finally the excessively long production times.

EP-A 0 920 954 discloses an apparatus for beveling panes of cut glass that uses two belt grinders.

SUMMARY OF THE INVENTION

The aim of the present invention is to solve the above-noted problems, eliminating all the drawbacks of the known prior art, by providing a machine that allows to grind the borders of glass panes safely and cheaply, obtaining a better qualitative result than the background art.

Within this aim, an object of the present invention is to automate the grinding operation, minimizing interventions of operators.

Another object is to avoid altering the structure of the production line by exploiting the modularity that typically characterizes it.

Another object is to ensure symmetrical beveling of the edges, regardless of the surface irregularity of the border of the pane or panes of laminated glass.

A further object is to perform grinding in a manner that is substantially independent of the perimetric profile of the glass pane.

A still further object is to eliminate the surface irregularities that typically characterize the lateral surface of glass panes.

This aim and these and other objects that will become better apparent hereinafter are achieved by an automatic machine for grinding the borders of substantially flat glass panes, characterized in that it comprises a machine body and at least one machining head, which is suitable to make contact with the borders of the pane and can move along the perimeter of the pane, said at least one machining head comprising a tool body that is movable substantially transversely to the plane of the pane, the tool body comprising an abrasive tool for grinding and at least one feeler element arranged upstream of the machining area of the abrasive tool with respect to the direction of relative advancement of the tool with respect to the pane, so as to make contact with the border of the pane being machined before the abrasive tool, the tool body further comprising sensors suitable to detect a relative movement between the feeler element and the abrasive tool caused by local misalignment between the border of the pane being machined and the abrasive tool, the machine further comprising a controller for receiving feedback signals from the sensors and actuation means that are operated by the controller in response to the feedback signals, in order to regulate the mutual position of the abrasive tool and of the border of the pane being machined.

Advantageously, the tool body comprises at least two sensors, a first sensor being suitable to detect transverse misalignment of the abrasive tool with respect to the plane of the pane by means of the feeler head and a second sensor being suitable to detect, by means of the feeler head, the tangent relationship of the machining region of the abrasive tool with respect to the pane border being machined.

Preferably, the feeler head comprises a wheel that substantially has the same profile as the abrasive tool and is rotatably pivoted on a laminar arm, which in turn is pivoted to the tool body.

BRIEF DESCRIPTION OF THE DRAWINGS

Further characteristics and advantages of the present invention will become better apparent from the following detailed description of particular embodiments of the invention, illustrated merely by way of non-limiting example in the accompanying drawings, wherein.

DESCRIPTION OF THE PREFERRED EMBODIMENTS

As described earlier, FIG. 1 schematically illustrates the peripheral portion of the double-glazing unit according to an exemplifying series of possible combinations: normal configuration (1A), triple-glazing unit (1B), staggered glass panes (1C), laminated outer pane and low-emissivity inner pane (1D), toughened reflective outer pane and laminated low-emissivity inner pane (1E). The two types of sealant used are illustrated: the butyl sealant 1004, which has a sealing function (first seal) and is applied between the lateral surfaces of the frame and the glass panes, and the polysulfide or polyurethane or silicone sealant 1005, which is adapted to provide mechanical strength (second seal) and is applied between the outer surface of the frame and the inner faces of the glass panes up to their border.

Figure 1:
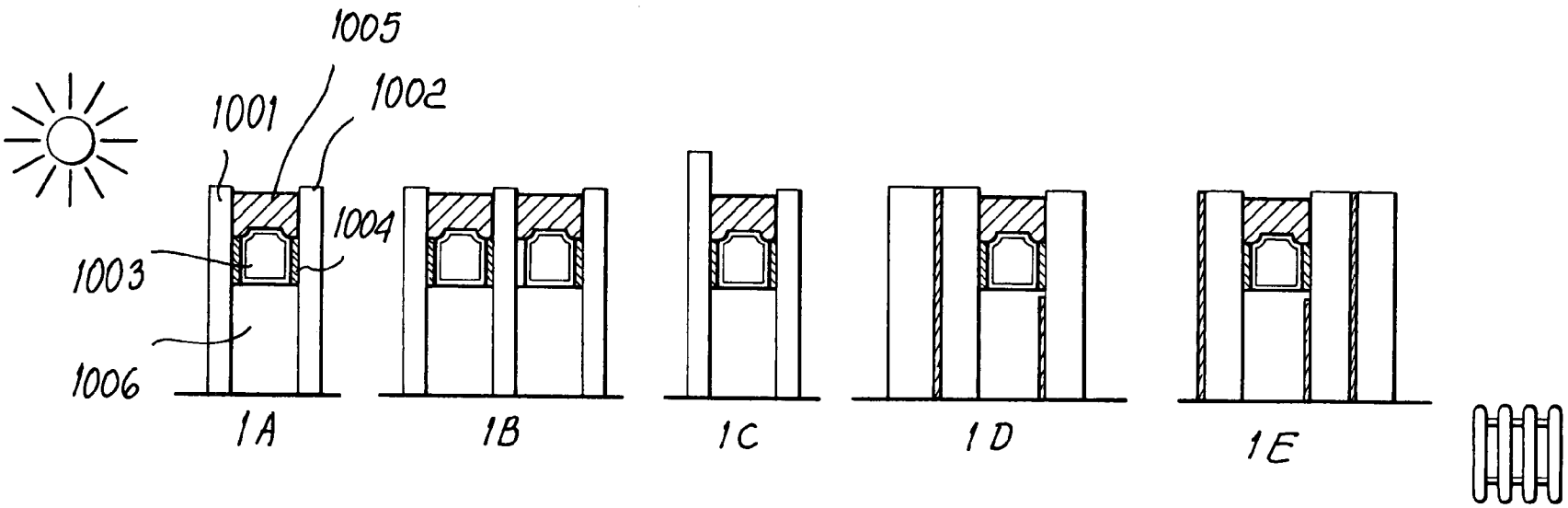
FIG. 1 is a partial sectional view of a plurality of typical configurations of a double-glazing unit.

FIG. 1 shows that, even after the second seal is applied, the double-glazing unit has two outer perimeters that are particularly dangerous due to the sharpness of the edges of the glass panes. It is in fact known that the border of the glass pane obtained by mechanical cutting (scoring with diamond tool and subsequent breaking by localized flexing) has borders that can cut like a sharp blade. It is also known that the border of cut glass panes is never perfectly perpendicular to the plane of the panes but is typically inclined, as shown by way of example in FIGS. 11*a*, 11*b*, 12*a* and 12*b*.

With reference to the figures, single-digit numerals designate the main units of the machine so as to have an overview thereof, while the constructive mechanisms and details are designated by three-digit numerals, the first digit of which being the digit of the main unit to which they belong.

The reference numeral 1 designates the "single" glass pane, in which the sides being machined (in the case of two machining heads) are respectively the front side 1*a*, the longitudinal sides 1*b* and 1*c* (which are machined simultaneously), and the rear side 1*d*.

Figure 2:
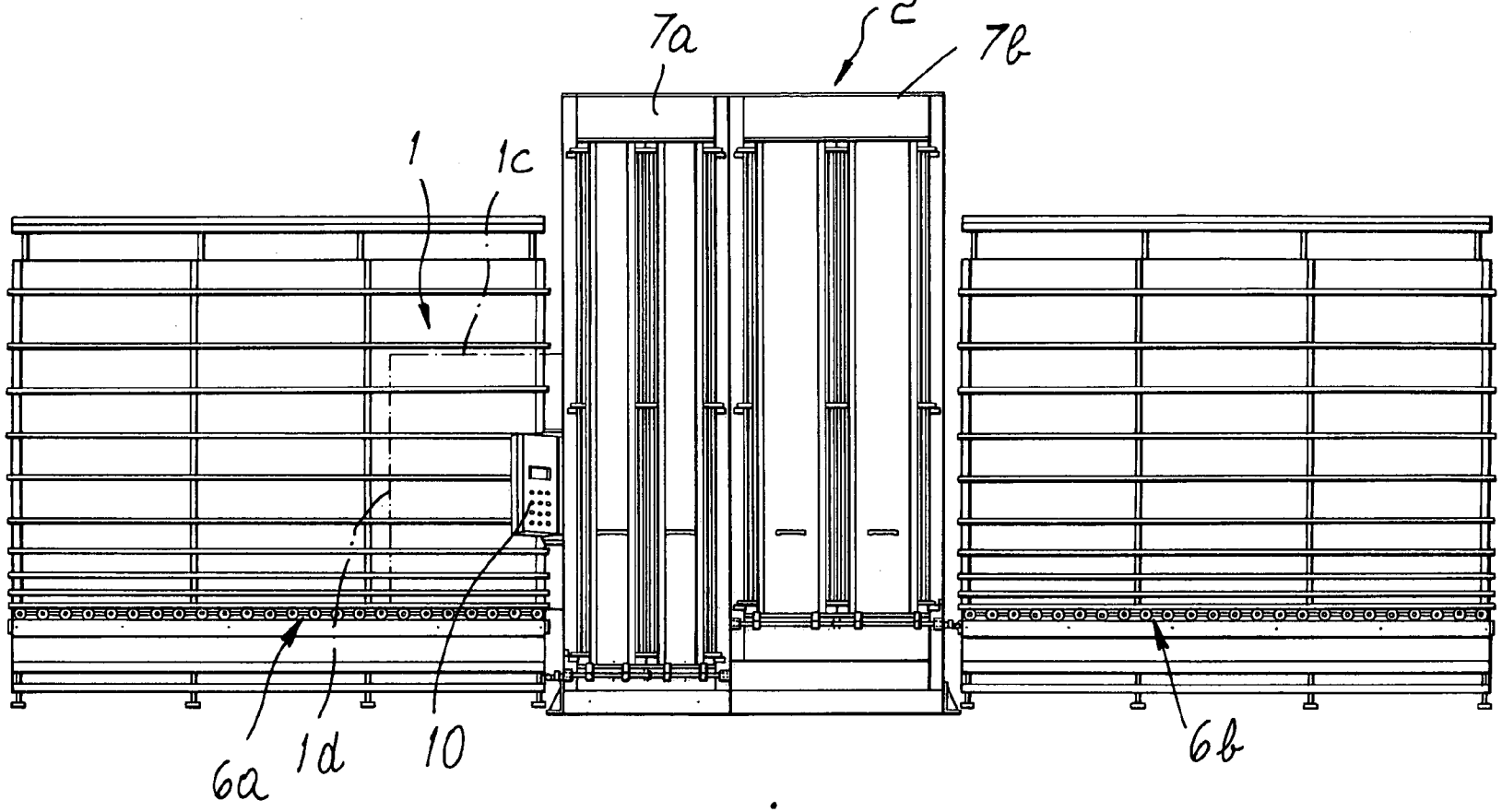
FIG. 2 is a general front view of a machine that incorporates the invention.

With reference to FIG. 2, the machine according to the preferred embodiment comprises a main body 2, which is cascade-connected between two conveyors 6*a* and 6*b*, which are arranged respectively upstream and downstream of the machine body 2. The machine body 2 comprises a grinding or beveling section 7*a* and preferably a washing section 7*b* in order to clean the glass panes after grinding.

For safety reasons, the sections of the machine body can be delimited by protective barriers 8, shown by way of example in FIG. 2, which can comprise the enclosure itself of the machine. As an alternative, the barriers may be of an optical (or laser) type or can comprise electrically sensitive mats. Such barriers allow to prevent injuries caused by reckless access to the inside of the machine on the part of an operator.

Figure 3:
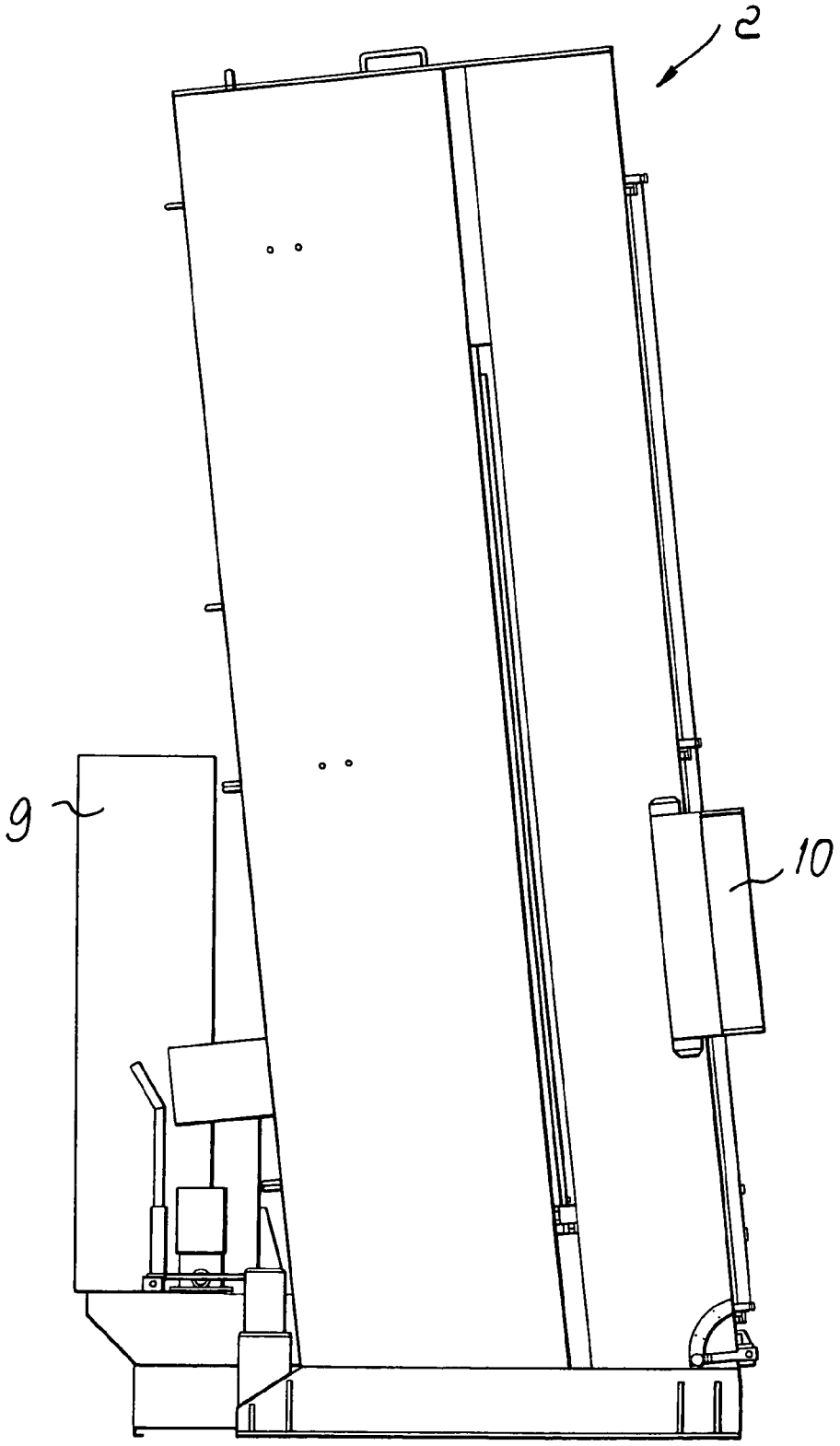
FIG. 3 is a general side view of the core of the machine that incorporates the invention.
Figure 4:
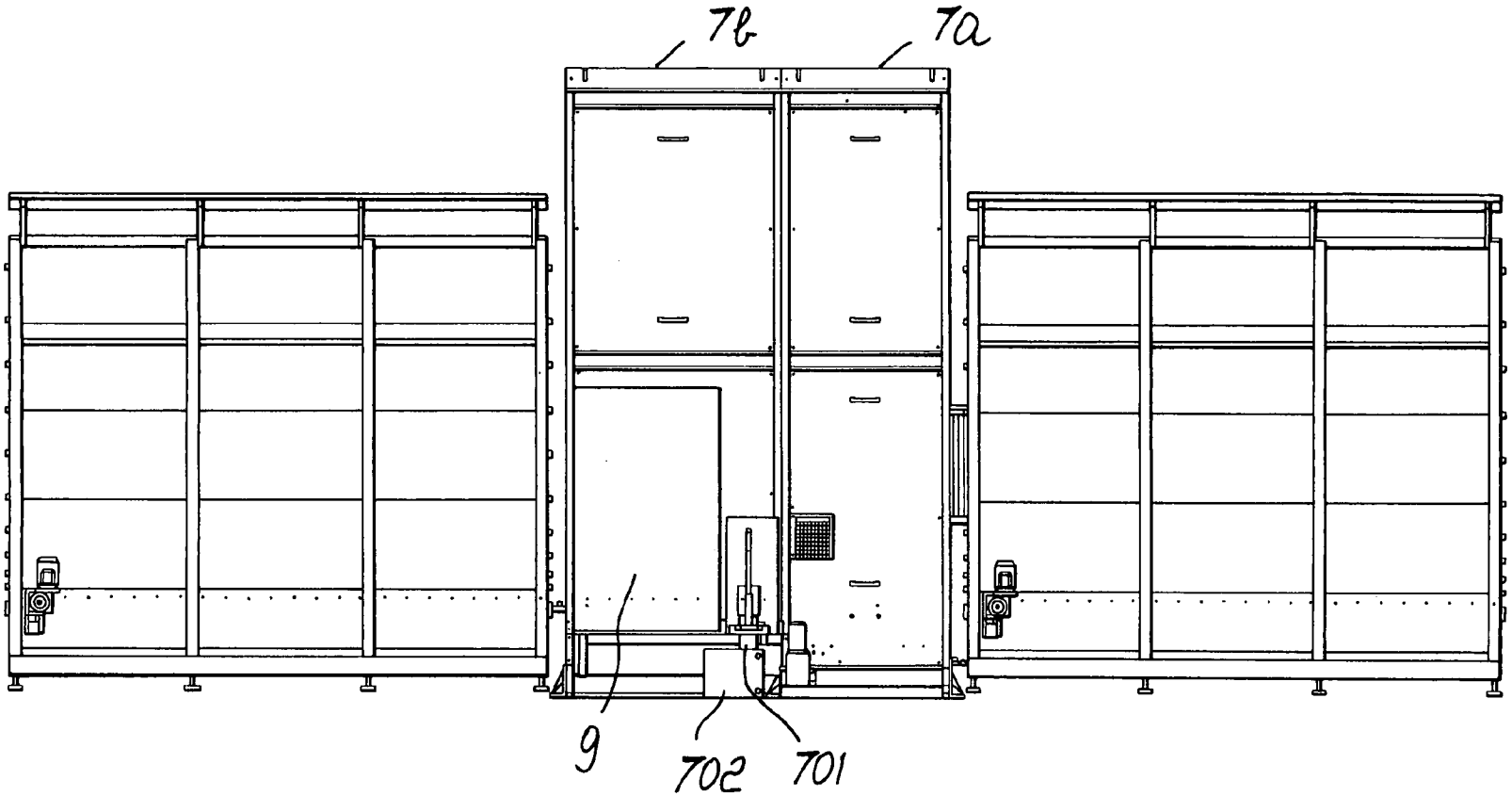
FIG. 4 is a general rear view of the machine that incorporates the invention.

With reference to FIG. 3, at the rear of the machine an electrical/electronic panel 9 is provided for managing the operating steps of said machine, which are described hereinafter. An optional control post 10 is connected to the machine in order to change process parameters manually.

The optional washing station 7*b* comprises a hydraulic pump 701, which draws water from a recirculation tank 702, in order to direct a stream of water toward the washing nozzles of the section 7*b* and/or toward the grinding tools of the section 7*a*, so as to clean the pane and cool the machining area of the tools.

Figure 5A:
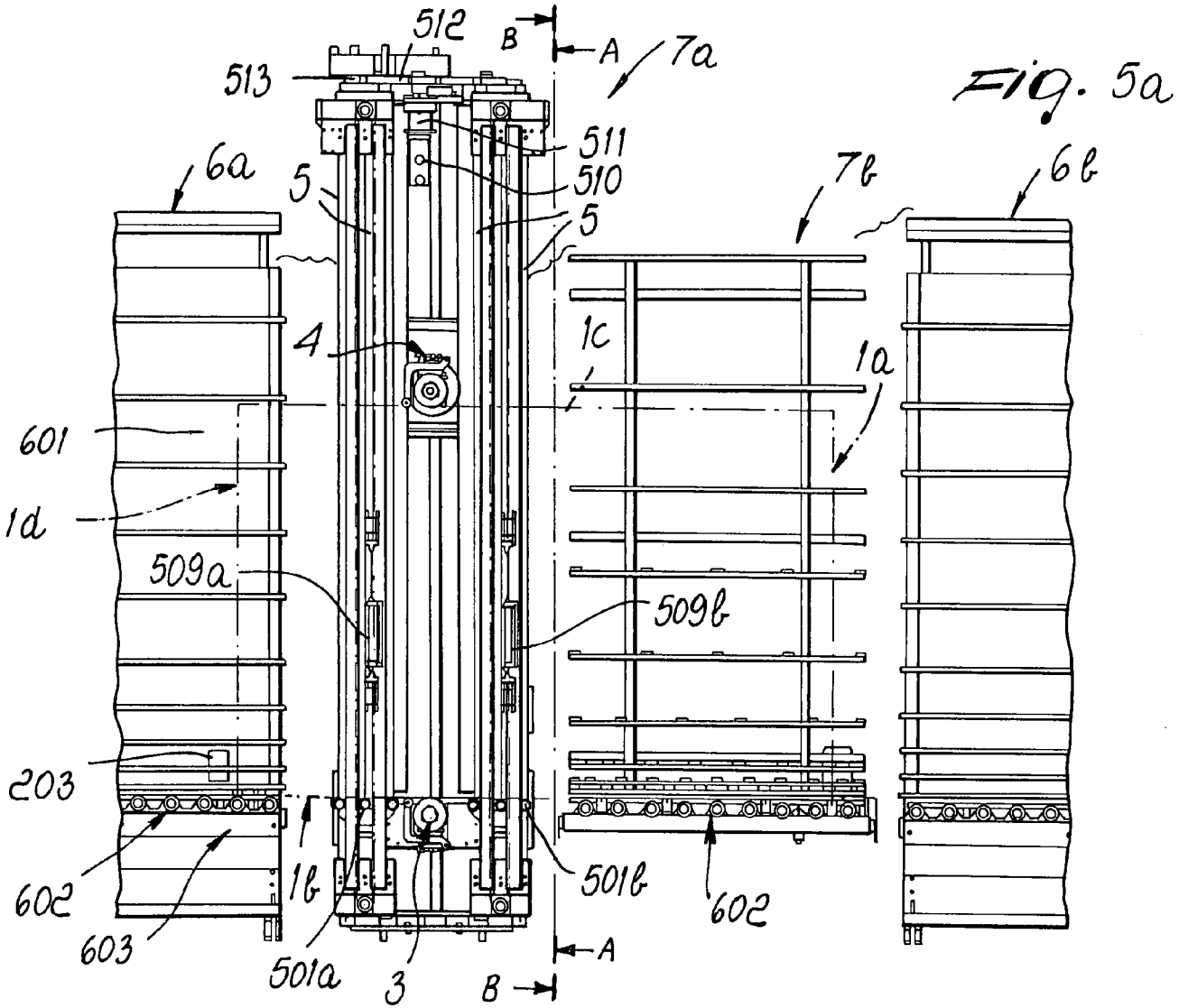
FIG. 5*a* is a schematic front view of the internal components of the machine according to the invention.
Figure 5B:
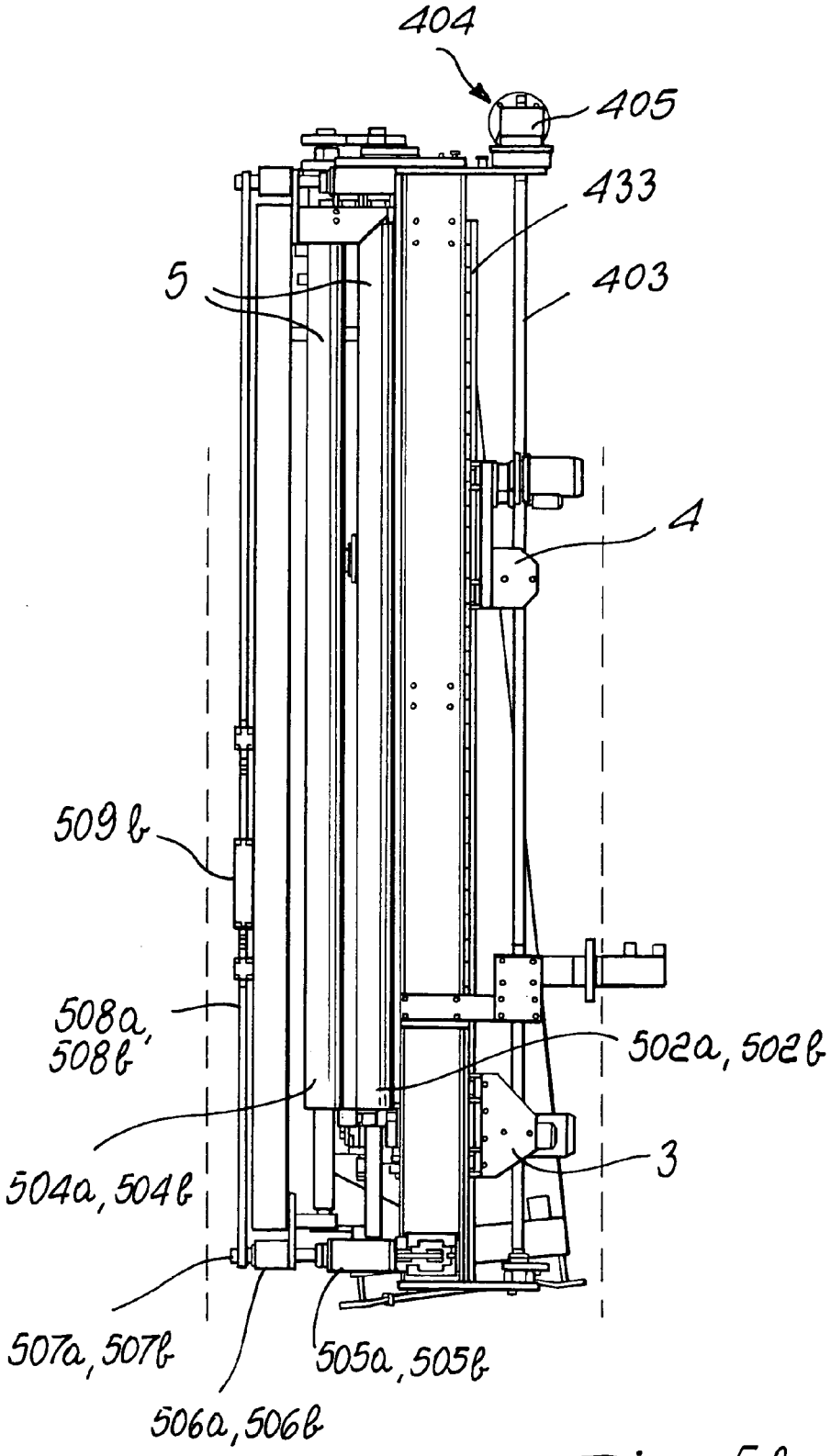
FIGS. 5*b* and 5*c* are lateral views, taken respectively along the direction indicated by the arrows A—A and along the direction indicated by the arrows B—B, of the grinding section of the machine according to FIG. 5*a*, in which the washing section has been removed.
Figure 5C:
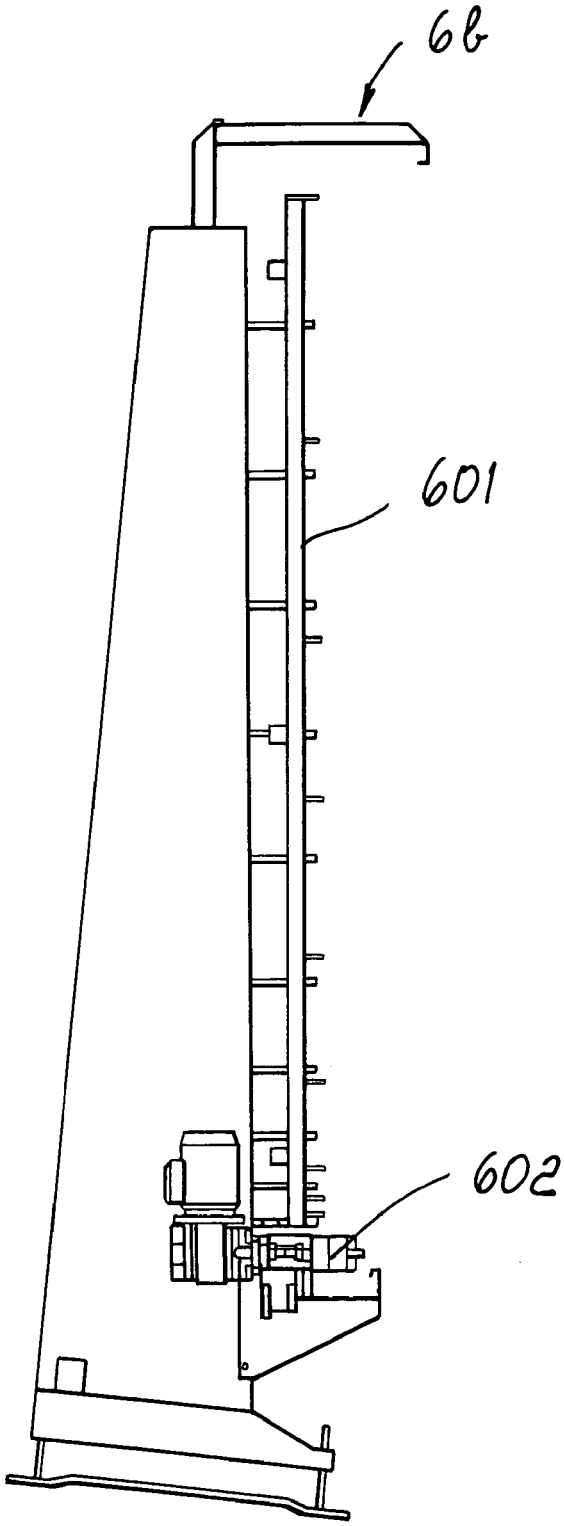

With reference to FIGS. 5*a*, 5*b* and 5*c*, the grinding section 7*a* comprises a lower machining head 3, an upper machining head 4, and a set of vertical traction rollers 5; said set comprises two pairs of front rollers 504*a*, 504*b* and two pairs of rear rollers 502*a*, 502*b*, respectively upstream and downstream of the section of the machine in which the machining heads work.

When the term "vertical" is used hereinafter with reference to the machine, an orientation is intended which is slightly inclined with respect to the direction that is perpendicular to the surface on which the machine rests. The pane is in fact typically carried on conveyors, the supporting surface of which is inclined by approximately 6 degrees with respect to the true vertical plane. Accordingly, the lower conveyance rollers provided on said conveyors (for example the conveyors 6*a* and 6*b*) also have an axis that is inclined by about 6 degrees with respect to the horizontal axis.

With reference to FIG. 5*a*, the machine according to one embodiment of the invention comprises the input conveyor 6*a*, the grinding section 7*a*, the output conveyor 6*b*, which are arranged sequentially. The optional washing section 7*b* is comprised between the grinding section 7*a* and the output conveyor 6*b*.

The input conveyor 6*a* can be connected to, or is comprised in, an upstream machining section, for example the section for cutting the glass into panes. As an alternative, the glass pane to be beveled can also be loaded manually onto the input conveyor independently of the production line.

The output conveyor 6*b* can instead be connected to, or is comprised in, a downstream machining section, for example the section where manufacturing of double-glazing units is provided. Both conveyors, as well as the central machine body, keep the pane at an inclination of approximately 6 degrees with respect to the vertical; however, for the sake of clarity, the view of FIG. 5*a* is taken along an axis that is perpendicular to the plane of the pane being machined, and the views of FIGS. 5*b* and 5*c* are likewise taken from the viewpoint of the front of the pane being machined.

The input conveyor 6*a* comprises a base 603 for supporting the lower border of the glass pane, on which a series of supporting and conveyance rollers 602 is arranged. The conveyor further comprises a supporting surface 601, on which the glass pane is rested in a substantially vertical position in the sense described above.

The conveyors are widely known and therefore are not described here in detail. It is therefore straightforward to understand that the output conveyor 6*b* is substantially similar to the input conveyor.

The input conveyor preferably comprises a thickness detector 203 of a known type for measuring the thickness of the glass pane to be machined before it enters the grinding section 7*a* and for producing an initial centering signal of the machining tools with respect to the border of the glass pane.

The grinding section 7*a* internally comprises a series of free rollers 501*a* and 501*b* for supporting the base of the glass panes during machining.

As mentioned above, the section 7*a* further comprises a first pair 504*a* of consecutive input traction rollers, which face a second pair 502*a* of consecutive input traction rollers; said rollers are arranged vertically so that a glass pane that enters the machine body is accommodated and retained between the first and second pairs of rollers.

In output from the grinding section there are two other pairs 504*b* and 502*b* of vertical rollers, which are fully similar respectively to the vertical input rollers 504*a* and 502*a* both from the structural and the operating standpoint, as described hereinafter.

In FIG. 5*b*, the vertical input rollers, as well as all the components that actuate them, are hidden, since FIG. 5*b* is a view of the machine body taken from the viewpoint indicated by the arrows A—A.

The input components are designated by the letter "a" at the end of the corresponding reference numeral, and the letter "b" designates the output components, which have substantially the same structural and functional characteristics.

Figure 5D:
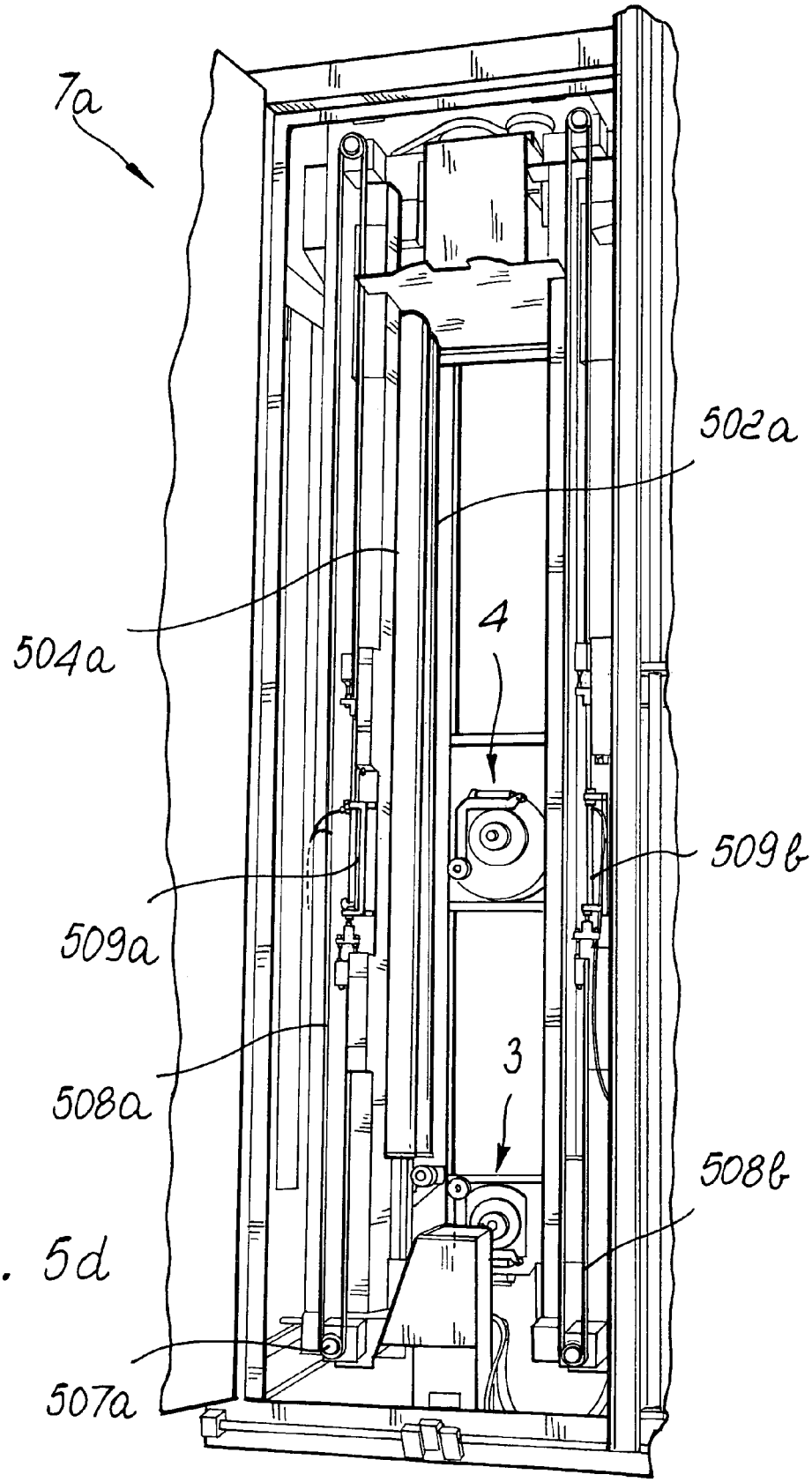
FIG. 5*d* is a perspective view of the grinding section of FIG. 5*a;*

With reference to FIGS. 5*b* and 5*d*, the rollers 504*a*, 504*b* can slide in a transverse direction on respective guides 505*a*, 505*b* and can move by means of an actuation system of the screw-and-nut type 506*a*, 506*b*, which is actuated by pulleys 507*a*, 507*b* and by a respective belt 508*a*, 508*b*. The belt closes onto a pneumatic through rod cylinder 509*a*, 509*b*, in order to move said belt as a consequence of appropriate commands of the controller of the machine, actuated by means of an electric valve.

In particular, the movement of the sliding vertical rollers 504*a* and 504*b* away from the fixed rollers 502*a* and 502*b* caused by the action of the cylinders 509*a*, 509*b*, respectively, is controlled by the controller of the machine and by means of known transit sensors (not shown in the figure), which are mounted on the machine directly upstream of the vertical input and/or output rollers and are adapted to produce an activation signal toward the controller as soon as the forward edge 1*a* of the glass pane passes beyond them.

The grinding section 7*a* further comprises a motor 510, which is connected by means of a reduction unit 511 to a transmission mechanism that comprises a belt 512 and a pinion 513, by means of which the vertical input rollers are made to rotate in order to produce the advancement of the glass pane. The motor 510 is also connected to the controller of the machine so as to actuate the vertical rollers in response to a command of the controller.

The machine preferably comprises similar (if not the same) mechanisms for moving the vertical output traction rollers.

The glass pane 1 that arrives from the previous treatment machine (or that is loaded manually or by means of a loading unit onto the input conveyor 6*a* of the machine) is made to advance, carried by the supporting and conveyance rollers 602 of the conveyor 6*a* and by the supporting rollers 501*a* of the grinding section 7*a*, until it makes contact with the first rear vertical traction roller 502*a*. When the transit sensor is activated, the front vertical traction rollers 504*a* adapt their distance from the opposite rear rollers 502*a* according to the thickness of the glass pane 1 and produce a mutual force against the rear rollers 502*a*.

The mutually opposite forces that act against the glass pane 1 are proportional to the force applied by the pneumatic cylinder 509*a* that acts on the belt 508*a*, the pressure of which is indeed adjusted by the controller of the machine according to the reading of the thickness of the pane 1 or to the kind of the pane.

According to the mechanism described above, the glass pane is thus conveyed to the section where the machining heads 3 and 4 described hereinafter are active. Once the machining heads 3 and 4 have been passed, the other pairs of rollers 502*b*, 504*b* interact with the glass pane 1 by means of similar mechanisms 505*b*, 506*b*, 507*b*, 508*b* and 509*b*, which are not described in detail here because they are substantially identical to the mechanisms described above. In this manner, the glass pane has a valid support provided by the series of horizontal rollers 602, 501*a*, 501*b* and a coordinated and synchronized traction produced by the rear vertical rollers 502*a* and 502*b* and front vertical rollers 504*a* and 504*b*. Said control of the position of the glass pane 1 is important for the correct operation of the process performed by the machining heads 3 and 4, as it will become apparent from the continuation of this description, and if the glass panes to be machined are non-rectangular, it is important also for the coordination of the horizontal movement of the glass pane and of the vertical movement of the machining head 4, required in order to ensure that the grinding tool is always mated with the perimeter of the non-rectangular glass pane 1.

Once the vertical border 1*a* of the glass pane 1, synchronized thanks to the actuation of the above cited vertical rollers, arrives at the machining head 4, the traction movement of the rollers is stopped (due to the action of other transit sensors, which are not shown).

Figure 6:
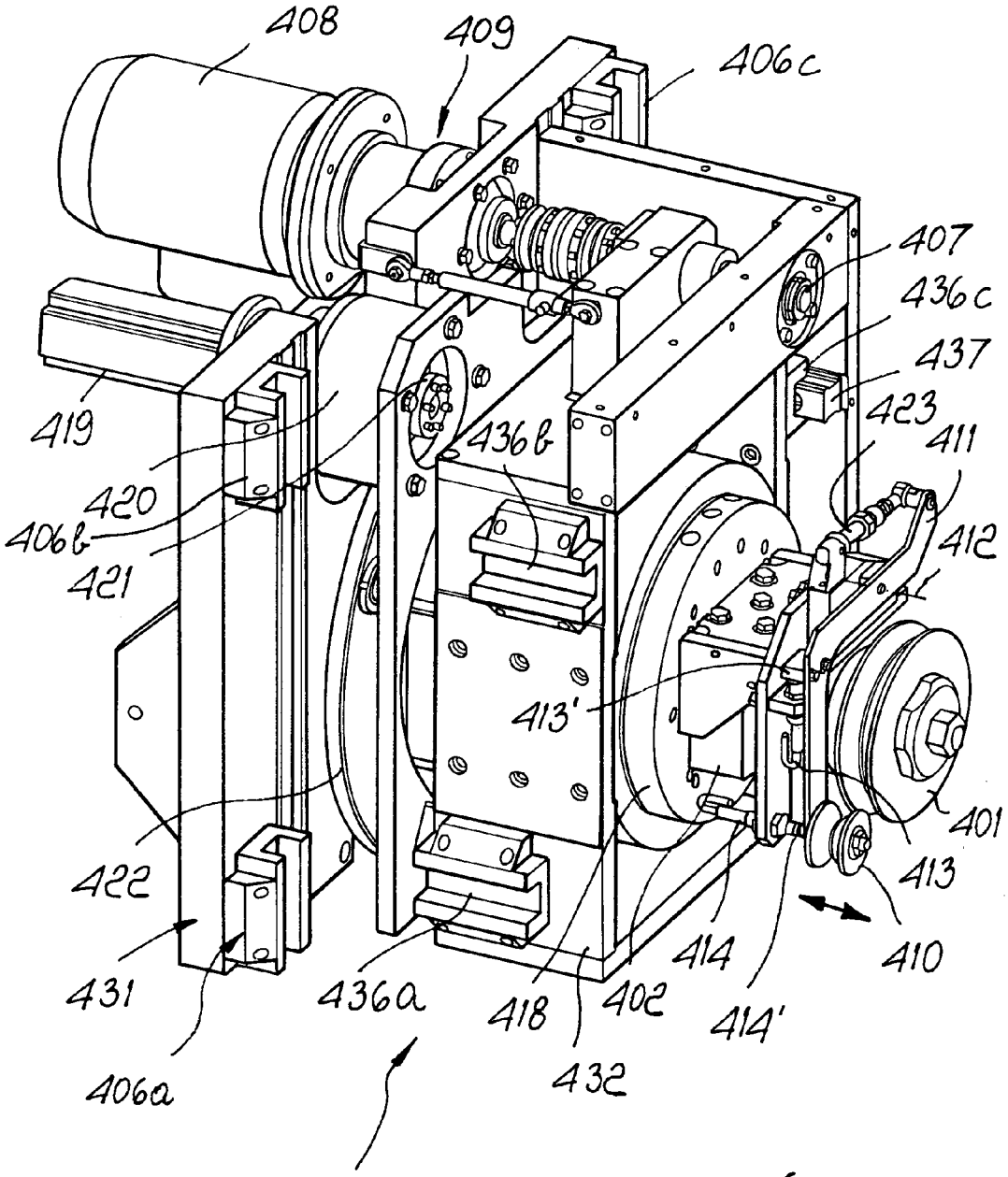
FIG. 6 is a perspective view of the upper machining head of the machine according to the invention.
Figure 7:
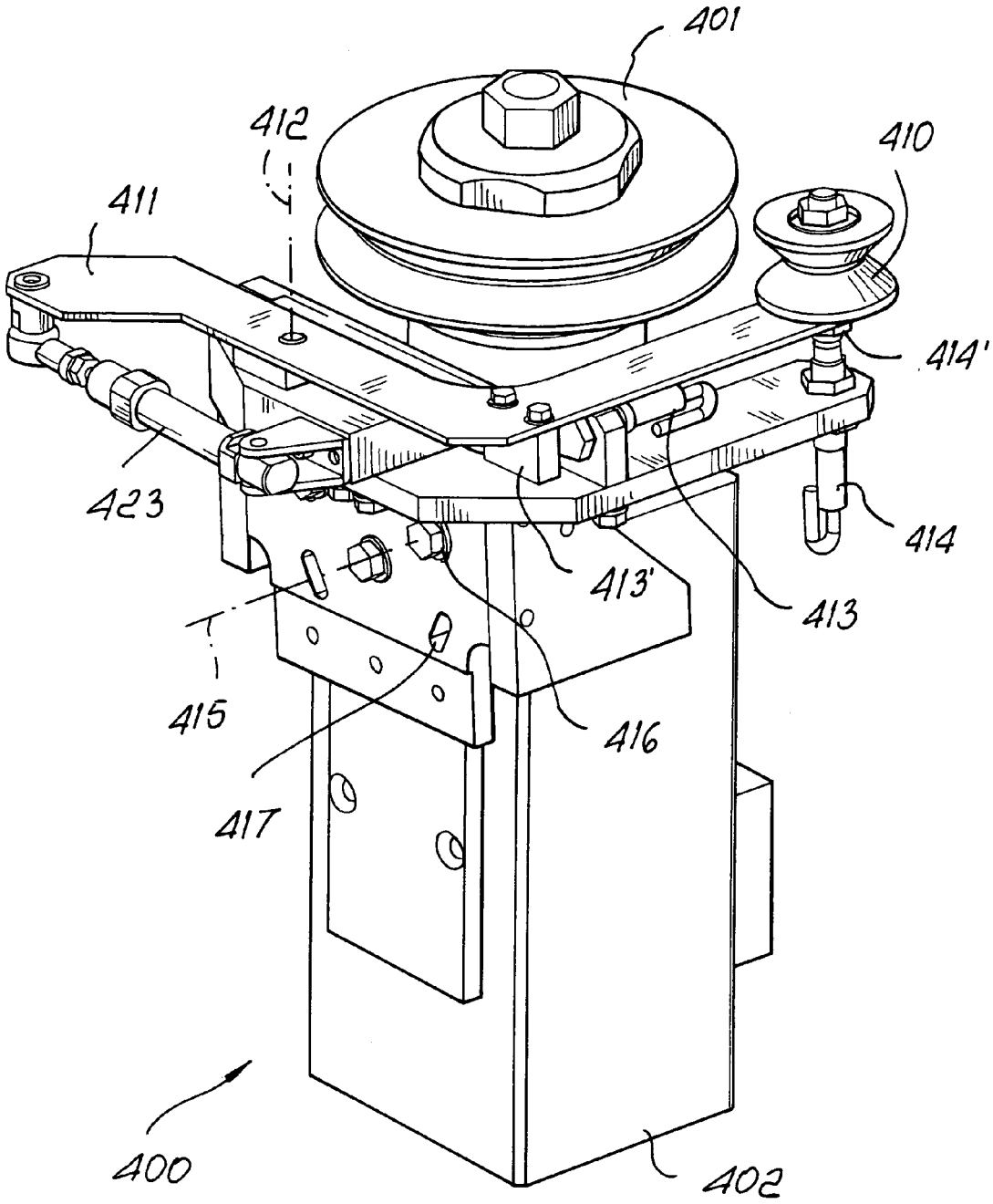
FIG. 7 is a perspective view of the tool body of the upper machining head of FIG. 6.

With reference to FIGS. 6 and 7, the machining head 4 comprises an abrasive tool 401, typically in the form of a diamond grinding wheel with a V-shaped profile, by means of which edging is performed on both of the perimetric edges of the glass pane 1. The grinding wheel 401 is connected to a coaxial motor 402, which provides it with a rotary motion.

The machining head 4 comprises a first supporting frame 431, on which a motor 408, for moving the tool substantially transversely to the plane of the glass pane, and a motor 419, for rotating the tool body 400 about an axis that is substantially perpendicular to the plane of the glass pane, are mounted.

The supporting frame 431 is connected to a ballscrew 403, which in turn is connected, by means of a reduction unit 405, to a motor 404 mounted on the machine body 2, for movement in the vertical direction (in the sense described above) of the movable machining head 4. The vertical movement is guided by means of the sliding of ballscrew sliders 406*a*, 406*b*, 406*c*, 406*d* provided on the frame 431 along guides 433 appropriately provided on the rear part of the machine body 2.

A second frame 432 is mounted on the supporting frame 431, can slide substantially at right angles to the plane of the glass pane, and comprises sliders 436*a*, 436*b*, 436*c* and 436*d* for sliding on respective guides (for example the guide 437) provided on the supporting frame 431. The second frame 432 is connected to the motor 408 by means of a ballscrew 407 and a reduction unit 409, so that the sliding of the frame 432 with respect to the supporting frame 431 is actuated by the motor 408.

A rotating turret 418 is further mounted on the second frame 432 and is connected to the motor 419 by means of a reduction unit 420, a pinion 421 and a ring 422. The motor 402 and the tool 401 are mounted on the rotating turret 418 so as to allow the rotation of the tool body 400 about an axis that is perpendicular to the plane of the glass pane.

The tool body 400 further comprises a feeler element or probe 410, which is mounted on a laminar arm 411, which in turn is pivoted to the tool unit by means of a pivot 412 and is further connected to the tool unit by means of a piston 423. The feeler head is preferably a wheel that substantially reproduces the same shape and thickness as the grinder 401 although having a smaller diameter than that of the grinder.

Therefore, the feeler head 410 preferably has the same profile as the grinder 401, i.e. it has a biconical profile (as shown in the figures).

The piston 423, connected to the controller of the machine, is used substantially to keep the feeler head 410 pressed against the edges of the glass pane being machined, as described hereinafter.

The flexibility of the lamina 411 allows to have mobility thereof substantially at right angles to the plane of the glass pane, while the pivot 412 allows a partial rotation of the lamina 411. In this manner, the feeler element 410 can move both due to the rotation about the pivot 412, and therefore on a plane that is parallel to the glass pane 1, and due to the flexibility of the lamina 411 itself, and therefore at right angles to the glass pane 1.

In order to detect the movement of the probe 410 substantially transversely to the plane of the glass pane 1, the lamina 411 is coupled by means of a sensor 414 with a corresponding plate 414' to the fixed part of the machining head 4, which is rigidly coupled to the turret 418. Advantageously, a second sensor 413 with a corresponding plate 413' is provided between the lamina 411 and the tool body 400, so as to detect the rotation of the lamina 411 with respect to the inactive or zero position.

The sensors 413–413' and 414–414' are connected to the controller of the machine in order to continuously transmit the displacement of the position of the feeler element 410 with respect to the inactive or zero position during grinding, in order to adjust the mutual position of the tool 401 with respect to the border of the pane 1 being machined.

Figure 8A:
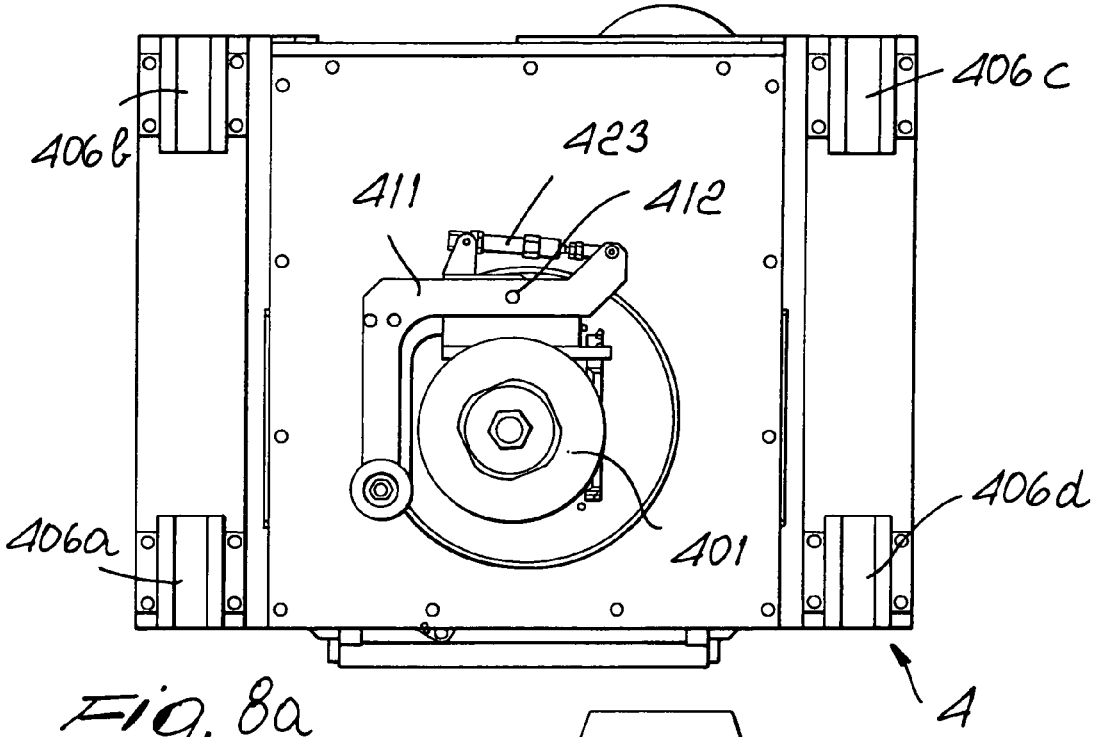
FIGS. 8*a* and 8*b* are respectively a front view and a top view of the assembly that comprises the upper machining head.
Figure 8B:
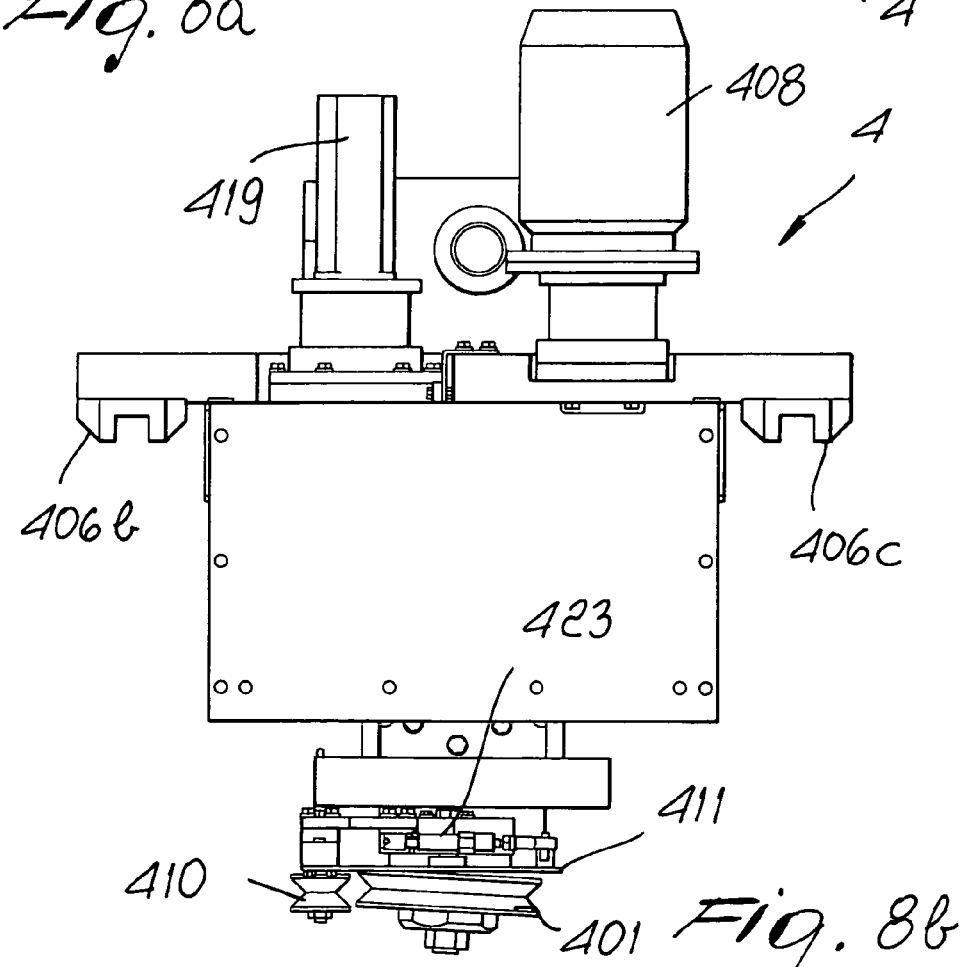

With reference to FIGS. 7 and 8*b*, the machining head 4 comprises advantageously a support for adjusting the inclination of the tool 401 with respect to the plane of the glass pane. In particular, it is preferred to adjust this inclination so as to form linear contacts instead of point-like contacts between the tool 401 (of the biconical or pseudo-biconical type) and the borders of the glass pane, with a consequent improved cutting action of the tool and reduced tool wear.

Tool adjustment is performed for example by interaction between screws 416 and slots 417 with reference to the axis 415 shown in FIG. 7.

Figure 9:
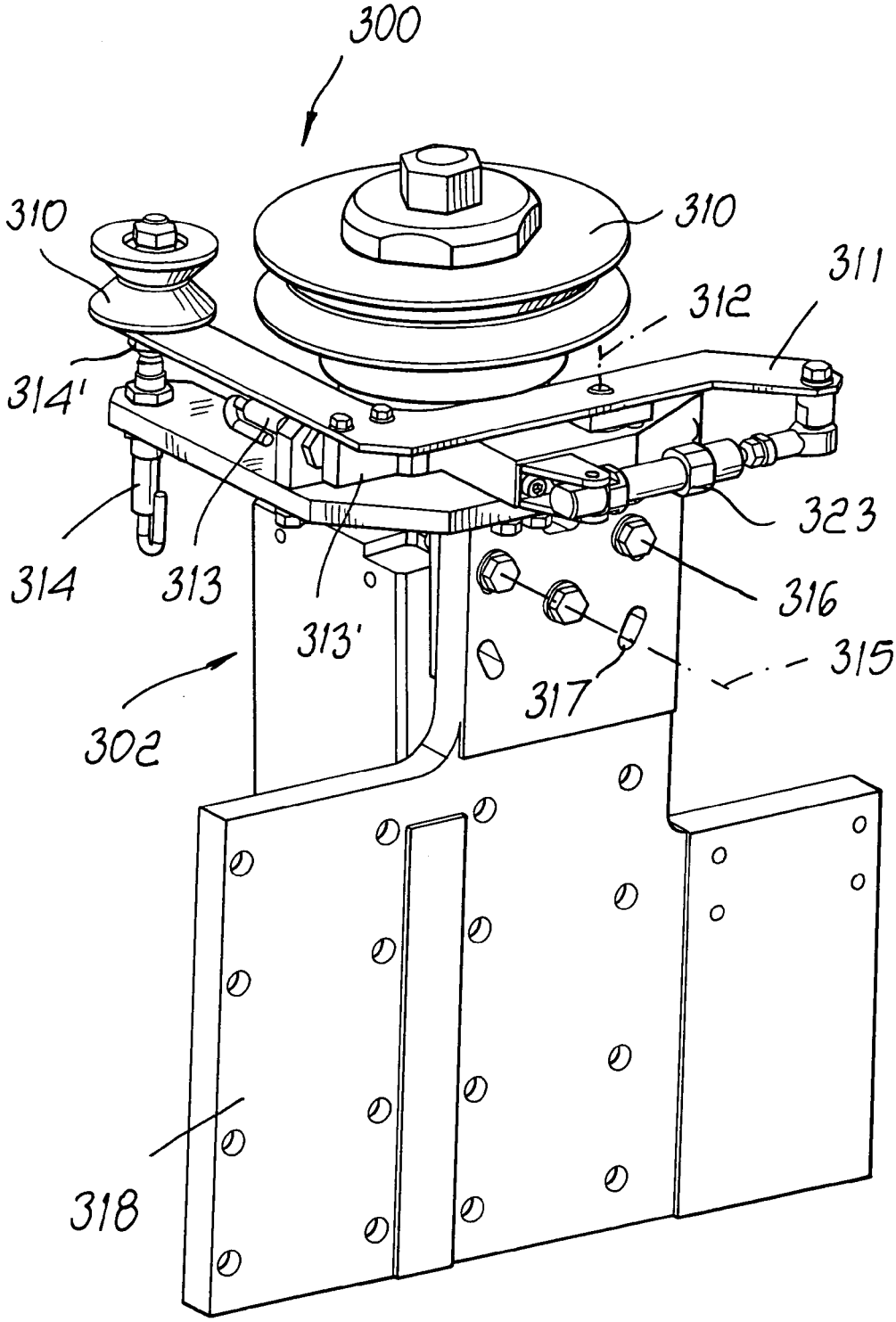
FIG. 9 is a perspective view of a detail of the lower machining head.
Figure 10A:
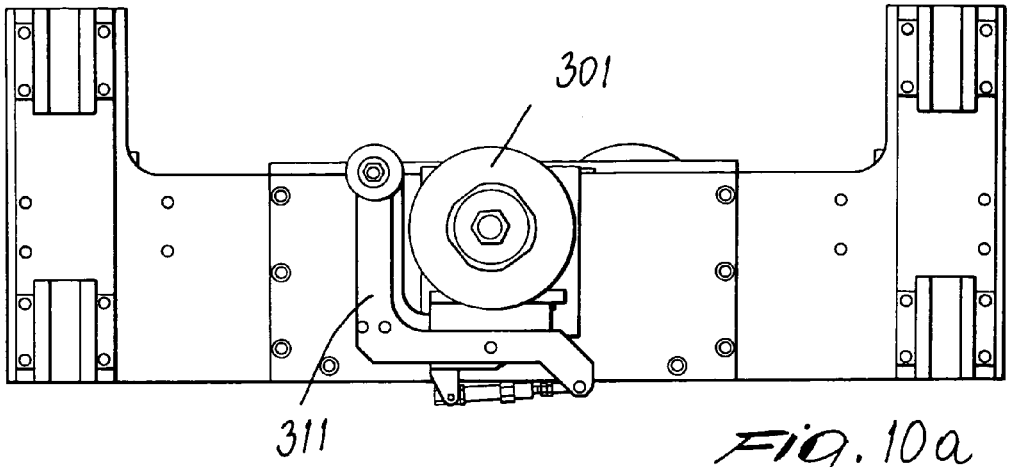
FIGS. 10*a* and 10*b* are respectively a front view and a top view of the lower machining head of the machine according to the invention.
Figure 10B:
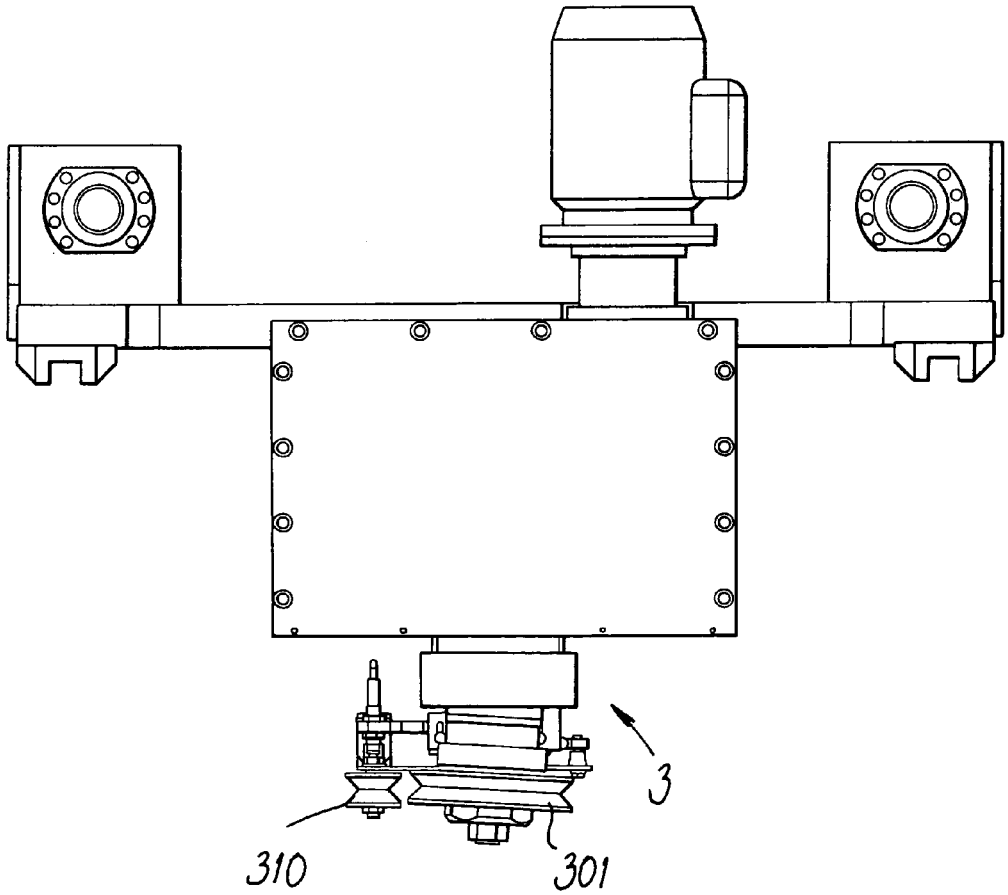

The main components of the upper machining head 4 are also provided in the lower machining head 3 of the machine. In particular, with reference to FIGS. 9, 10*a* and 10*b* the machining head 3 comprises a tool 301, which is actuated by a coaxial motor, and a feeler head or probe 310. The tool body composed of these three elements is mounted on a fixed plane 318, which is fixed at the footing of the machine or, in an alternative embodiment, is mounted on a lifting device that is similar to the one provided for the movement of the upper machining head 4 in a vertical direction (FIGS. 10*a* and 10*b*). In this second case, the lifting device is used to allow complete machining on the part of the machining head 4 on the sides 1*a* and 1*d* of the pane.

The probe 310 is preferably a wheel, which is mounted on a flexible lamina 311, which in turn is pivoted to the support 318 along an axis 312. The rotation of the lamina about the axis 312 and its movement substantially transversely to the plane of the glass pane are detected by suitable sensor-plate pairs 314–314' and 313–313'.

While the fixed lower machining head 3 works with the side 1*b* of the glass pane 1, the movable upper machining head 4 works in progression with the sides 1*a*, 1*c* and 1*d* of the glass pane 1 and therefore with a continuous change of the active quadrant of said head. For this reason, in the case of substantially rectangular glass panes, the turret is actuated so as to perform finite phase rotations through 90°, while in the case of contoured glass panes the turret is moved continuously by means of the actuation of the motor 419, which therefore operates in synchronous tie with the drives of the motors 404 and 510, which in turn are mutually in synchronous tie.

The machine body 7*a*, the internal tools 301 and 401 of which work in a water stream, is adjacent to the nearby post-washing section 7*b*, which removes, by means of sprayers, the abrasive particles and the glass particles from the panes 1. The water stream is directed to the tools 301, 401 and to the washing section 7*b*, and is obtained by means of the pump 701, which draws water from the recirculation tank 702 and sends it through the filter 703 to the spray nozzles 704. This last washing system belongs to the background art.

The operation of the machine is as follows. The grinding step begins as soon as the front border 1*a* of the glass pane is moved at the machining heads 3 and 4.

The feeler at least partially makes contact with the border 1*a* of the glass pane 1, for example at the edge formed by the sides 1*a* and 1*b*. The shape of the feeler produces a movement of the lamina 411, which is detected at least by the sensor 414, if the border of the glass pane is not completely included within the groove of the wheel of the feeler.

Depending on the signal detected by the sensor 414 and optionally by the sensor 413, the controller of the machine (not shown in the figures), operates the axial movement of the tool in a direction that is substantially perpendicular to the plane of the glass pane by means of the motor 408.

Figure 11A:
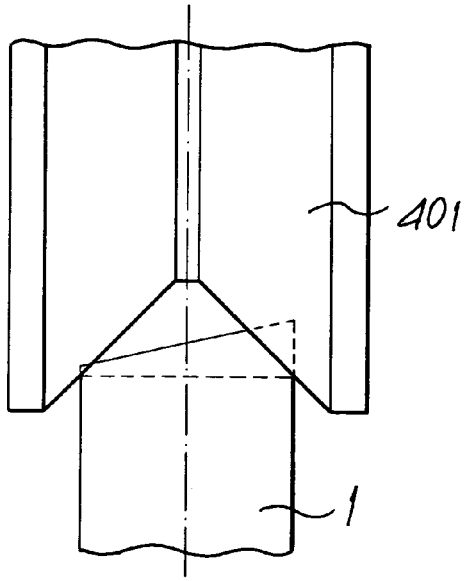
FIGS. 11*a* and 11*b* are views of the mutual arrangement of the grinding wheel and of an individual glass pane, respectively when there is no machining tool position regulation and when said regulation is present.
Figure 11B:
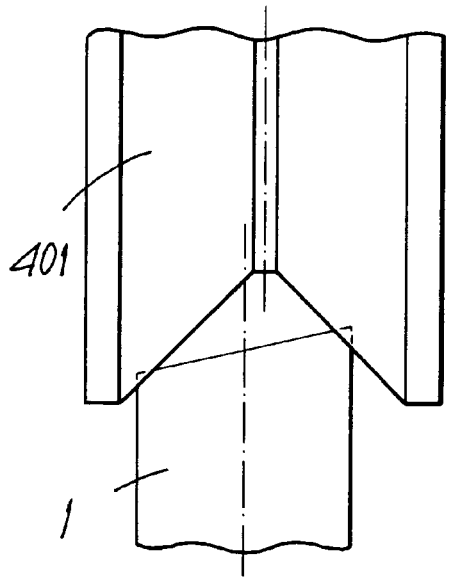
Figure 12A:
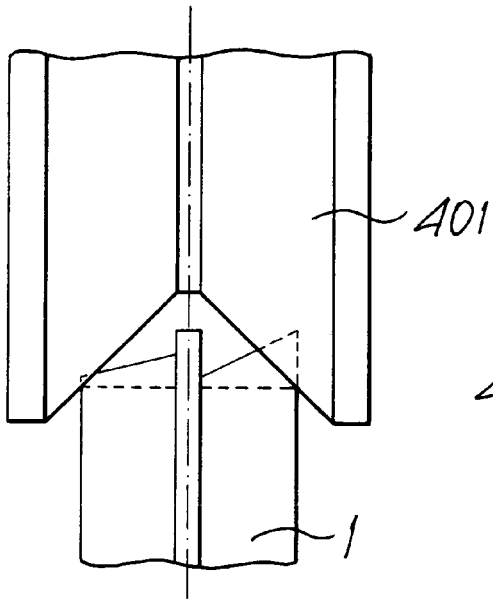
FIGS. 12*a* and 12*b* are views of the mutual arrangement of the grinding wheel and of a laminated glass pane, respectively when there is no machining tool position regulation and when said regulation is present.
Figure 12B:
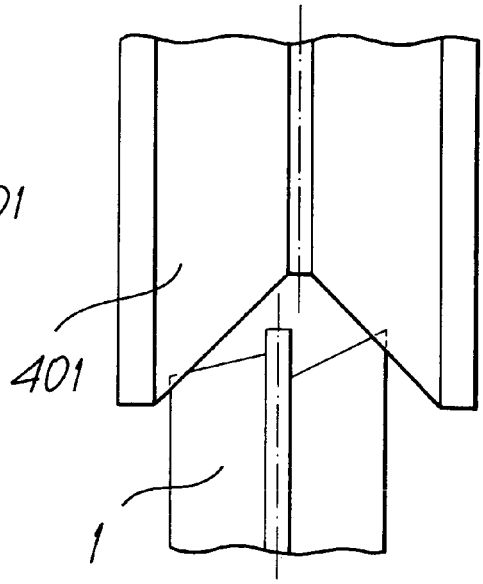

At this point, the machining head is moved in a vertical direction by means of the controller and the motor 404, so as to perform grinding along the entire side 1*a* of the glass pane. Grinding occurs advantageously symmetrically on both edges of the border 1*a*, as shown in FIGS. 11*b* and 12*b*, since the feeler tends to adapt to the border of the pane, slipping perpendicularly to the plane of the pane due to the pressure applied by the piston 423 so that both edges of the border of the pane are in contact with the internal surface of the feeler head. This advantageously avoids the asymmetric beveling effect that would occur if the groove of the tool were perfectly centered with respect to the centerline of the border of the glass pane, as shown in FIGS. 11*a* and 12*a*.

The displacement signals of the lamina 411 are continuously detected and fed back to the motor 408 by means of the PID controller of the machine, so as to follow any less than perfect flatness of the pane.

Moreover, the signals of the sensor 413, by means of the PID control system, provide feedback to the motor 510, repositioning the pane so that even if its vertical side 1*a* or 1*d* is not perfectly perpendicular with respect to the base 1*b* of the pane, its point of contact with the grinder 401 is instantaneously located in the position of the vertical line that passes through the tangent with respect to the grinder.

For example, the movements about the axis of the pivot 412 indicate a profile of the pane that is not perfectly rectangular but is for example trapezoidal. Accordingly, the feedback toward the motor 510 is useful in order to produce (i) the further advancement of the pane through the vertical rollers 502*a* and 504*a* if the angle between the sides 1*a* and 1*b* is acute, and (ii) the backward movement of the pane if said angle is obtuse, thus keeping unchanged the perimetric profile of the pane.

Likewise, the feedback of the signal sent by the feeler toward the motor 408 allows to move the tool 401 in a direction that is perpendicular to the plane of the pane 1, as described above.

As it is known, PID control allows optimum regulation of the process, since if x is the displacement of the value to be controlled (in the specific case, the distance between the sensor, for example, 413 and the plate 413') that one wishes to return to the set value (in the specific case, zero), the motorized actuation means that restore the set situation act with a power that is proportional to:

the linear value x (displacement), its derivative over time (speed), its integral over time, allowing to attenuate the minimal off-sets that were not eliminated completely with the two preceding actions.

Moreover, the proportionality bands can be set to appropriate ranges.

This control system can be provided with the functions made available by the programmable logic of the controller, advantageously of the PLC type, and is particularly necessary in order to avoid instability, resonance, vibration and drift phenomena that tend to be triggered autonomously if the contact between the abrasive tool and the glass pane combined with the cutting and feeding motions of the tool 301, 401 itself is not properly and dynamically controlled in terms of physical value.

The description provided above refers to a grinding machine in which the source machine (edging machine) is arranged to the left and the destination machine (washer) is arranged to the right of said grinding machine; it is easy to imagine a description and corresponding figures in the case of mirror-symmetrical or otherwise different arrangements.

All the movements related to the steps of the cycle are of course mutually interlocked, by virtue of a parallel but always active logic system, in order to avoid, during the process, conditions of mutual interference between the actuation elements, the tools and the material being machined.

It is evident that the industrial application is a sure success, since machines for edging glass are currently not widely used. Moreover, the double-glazing unit market is growing continuously, since in recent years it has been increased by all those configurations that require the use of special glass panes such as the ones described in the introduction (and particularly toughened glass panes, which require arrissing as a preparatory step for toughening) and therefore border beveling is a very important added value that qualifies the product. Moreover, the spread of non-rectangular shapes, for example polygonal or curved or mixed shapes, further enhances the importance of the present invention, in contrast with the limitation of conventional machines, which can work only on rectangular shapes.

Moreover, one sector that is growing every day and also requires grinding of the edges and of the entire perimetric borders of glass panes 1 is constituted by glass toughening. For this application, the machine can assume either a vertical position or a horizontal position.

It has thus been shown that the machine according to the invention achieves the intended aim and objects. The invention is susceptible of numerous modifications and variations, all of which are within the scope of the appended claims. Thus, for example, the mechanical solutions for the motions for feeding the tools, for supporting and moving the glass pane, and the actuation means may be electrical, electrical-electronic, pneumatic, hydraulic and/or combined, and the control means may be electronic or fluidic and/or combined means.

Another embodiment of the invention is constituted by the logic combination of the actuations respectively for translational motion of the glass pane, for movement of the machining heads and for synchronization of the inclination of the tool so as to allow machining of shaped glass panes, i.e., non-rectangular glass panes. To achieve this, as described previously, the electronic actuation systems of the three motors 404, 510 and 419 are concatenated by means of a synchronous tie with numeric control.

The tools 301 and 401 may also have a shape (other than biconical) or be distributed in such a quantity so as to act not only on the edges of the glass pane but also on the entire face of the perimeter in order to grind not only the sharp edges but also the flat strip region between them, so as to eliminate defects, dust, contamination, et cetera. For example, the diamond grinder may have a profile that is different from the V-shaped or biconical one. In particular, it is straightforward to understand that if a cylindrical grinder is used, the same machine described so far can perform grinding operations on the profile of said pane in order to eliminate any defects or microcracks produced by the previous cutting operation to which said pane has been subjected.

Figure 13:
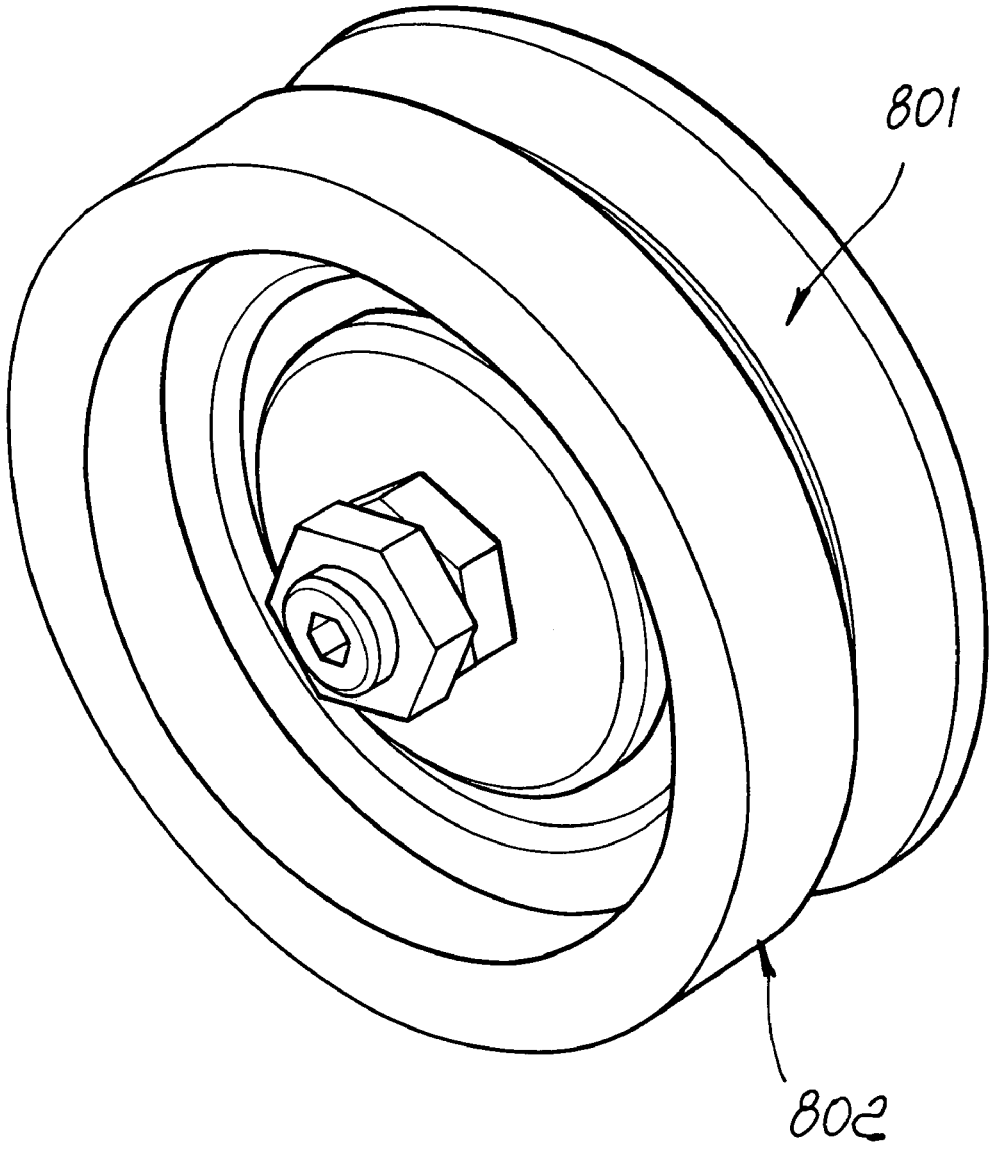
FIG. 13 is a perspective view of a grinding wheel used in a machine according to a particular embodiment of the invention.

The tool body may of course mount interchangeable tools for this purpose. The grinder may have a profile that comprises two adjacent sections, the first section 801 having a frustum or V-shaped profile and the second section 802 having a cylindrical shape, as shown in FIG. 13. In this case, it is possible to bevel the edges of the borders and to grind the surface comprised between said edges simply by moving transversely the grinder with respect to the pane 1 so as to use the portion having the V-shaped profile or having the cylindrical profile, respectively.

Moreover, in the light of the above description it is straightforward to understand that by using cylindrical grinders in the grinding operations it is possible to bevel the edges that connect the two sides of the pane.

The constructive details may be replaced with other technically equivalent ones. The materials and the dimensions may be any according to requirements, in particular as derived from the dimensions (base and height) of the glass panes 1.

The disclosures in Italian Patent Application No. TV2003A000091 from which this application claims priority are incorporated herein by reference.

What is claimed is:

1. An automatic machine for grinding the borders of substantially flat glass panes, comprising a machine body and at least one machining head, which is adapted to make contact with the borders of said pane and can move along the perimeter of said pane, said at least one machining head comprising a tool body that is movable substantially transversely to the plane of said pane, said tool body comprising an abrasive tool for performing said grinding and at least one feeler element, which has substantially the same profile as said abrasive tool and is arranged upstream of the machining area of said abrasive tool with respect to the direction of relative advancement of said tool with respect to said pane, so as to make contact with the border of said pane being machined before said abrasive tool, said tool body further comprising sensors suitable to detect a relative movement between said feeler element and said abrasive tool caused by a local misalignment between the border of the pane being machined and said abrasive tool, said machine further comprising a controller for receiving feedback signals from said sensors and actuation means that are operated by said controller in response to said feedback signals, in order to regulate the mutual position of said abrasive tool and of the border of said pane being machined.

2. The automatic machine of claim 1, wherein said tool body comprises at least two of said sensors, a first sensor being adapted to detect the transverse misalignment of said abrasive tool with respect to the plane of said pane by means of said feeler element and a second sensor being adapted to detect the tangency condition of the work area of said abrasive tool with respect to the border being machined of said pane by means of said feeler element.

3. The automatic machine of claim 1, wherein said feeler element comprises a wheel that has substantially the same profile as the abrasive tool and is rotatably pivoted on a laminar arm, which in turn is pivoted on a pivot of said tool body.

4. The automatic machine of claim 3, wherein said laminar arm is connected to said tool body by means of a piston, which is adapted to keep said feeler element in contact with the border being machined of said pane.

5. The automatic machine of claim 3, wherein said sensors comprise a sensor-plate pair, which is arranged between said laminar arm and said tool body and is adapted to detect movements of said feeler element substantially transversely to the plane of said pane, and a second sensor-plate pair, which is arranged between said laminar arm and said tool body and is adapted to detect rotary motions of said laminar arm about the pivot with respect to a zero position.

6. The automatic machine of claim 1, wherein said abrasive tool is a diamond grinding wheel.

7. The automatic machine of claim 6, wherein said diamond grinding wheel is of the biconical type, so as to symmetrically edge both edges along each border of said glass pane.

8. The automatic machine of claim 6, wherein said diamond grinding wheel comprises a cylindrical portion and a biconical portion, so as to grind the borders of said glass pane or edge their edges, depending on which portion of said grinder faces said borders.

9. The automatic machine of claim 1, wherein said machining head comprises a support for adjusting the inclination of said abrasive tool with respect to the plane of said pane.

10. The automatic machine of claim 1, wherein said machine body is extended in a substantially vertical direction so as to allow the insertion of said machine body in a line for machining glass panes arranged in a substantially vertical position.

11. The automatic machine of claim 10, wherein said machining head comprises a supporting frame for connection to said machine body, said frame being movable in a substantially vertical direction by means of sliders, which are rigidly coupled to said frame and can slide along appropriately provided guides provided on said machine body, said machining head further comprising a motor, which is mounted on said machine body in order to move said supporting frame in a vertical direction, said motor being controlled by said controller of the machine.

12. The automatic machine of claim 11, comprising a second frame mounted on said supporting frame so that it can slide substantially at right angles to the plane of said pane.

13. The automatic machine of claim 12, comprising a rotating turret, which is mounted on said second frame in order to support said tool body, said rotating turret being connected to a motor, which is adapted to rotate said rotating turret with respect to said second frame, allowing the rotation of said tool body about an axis that is substantially perpendicular to the plane of said pane, said motor being actuated by said machine controller in order to rotate said tool body depending on the border of the glass pane to be ground.

14. The automatic machine of claim 1, wherein said at least one machining head is comprised in a grinding section, which comprises a set of traction rollers for the advancement of said pane through said grinding section, said set of traction rollers being actuated by a motor in response to a signal of the controller of the machine, so as to move said glass pane in accordance with the feedback signals generated by said sensors.

15. The automatic machine of claim 14, wherein said set of traction rollers comprises front and rear rollers that face each other in pairs, said rear rollers being supported by respective guides so that each pair of said rollers can perform an opening and closing motion in order to accommodate and retain said pane, said opening and closing motion being actuated by a mechanism comprising a belt and pulleys, which is connected to a pneumatic through cylinder, which can be actuated by a signal that arrives from said controller of the machine.

16. The automatic machine of claim 14, wherein said controller is set so as to control rotation of said set of traction rollers and of said tool body for edging glass panes having profiles other than rectangular.

17. The automatic machine of claim 1, wherein said pane can be arranged on a substantially horizontal plane.

* * * * *